US006295932B1

(12) United States Patent
Kane, III

(10) Patent No.: US 6,295,932 B1
(45) Date of Patent: Oct. 2, 2001

(54) ELECTRONIC SAFE ARM AND FIRE DEVICE

(75) Inventor: James P. Kane, III, Altamonte Springs, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/267,767

(22) Filed: Mar. 15, 1999

(51) Int. Cl.[7] ..... F42C 15/24

(52) U.S. Cl. ..... 102/221; 102/221; 102/262; 102/265; 102/266; 102/270; 102/271; 102/215

(58) Field of Search ..... 102/221, 262, 102/265, 266, 270, 271, 215

(56) References Cited

U.S. PATENT DOCUMENTS

| | | | | |
|---|---|---|---|---|
| 3,756,181 | * | 9/1973 | Beach | 114/20 |
| 4,089,268 | * | 5/1978 | Jaroska et al. | 102/70.2 |
| 4,160,417 | * | 7/1979 | Fowler | 102/221 |
| 4,212,246 | * | 7/1980 | Eaton et al. | 102/270 |
| 4,291,627 | * | 9/1981 | Ziemba et al. | 102/265 |
| 4,667,598 | * | 5/1987 | Grobler et al. | 102/215 |
| 4,677,913 | * | 7/1987 | Farace | 102/215 |
| 4,686,885 | * | 8/1987 | Bai | 89/6.5 |
| 4,920,884 | * | 5/1990 | Haglund et al. | 102/215 |
| 5,042,742 | * | 8/1991 | Hufault et al. | 244/3.11 |
| 5,245,926 | * | 9/1993 | Hunter | 102/215 |
| 5,251,548 | * | 10/1993 | Spence | 102/221 |
| 6,034,365 | * | 3/2000 | Levin | 250/206.2 |

FOREIGN PATENT DOCUMENTS 0 433 697 6/1991 (EP) .

0125629 * 11/1984 (IL) .

* cited by examiner

*Primary Examiner*—Charles T. Jordan
*Assistant Examiner*—Lulit Semunegus
(74) *Attorney, Agent, or Firm*—Burns, Doane, Swecker & Mathis, LLP

(57) ABSTRACT

An electronic safe arm & fire (ESAF) device has a common module and a pair of programmable devices that are readily configurable to different missile types. The ESAF device has a first static arming switch that is controlled by the first programmable device and a second static arming switch that is controlled by the second programmable device. The ESAF device has a firing module that has an exploding foil initiator. The common module and the firing module can be configured as a standalone module in close proximity to a warhead or can be integrated into a warhead. The common module has some inputs that are used by all the missiles in a group for the same signals; some inputs that are used by all the missiles, but for different signals; and, some inputs that are used by some of the missile, but not by all of the missiles. The common module has an input port for a separation signal, a communications port for a fuze data signal, and an input port for a signal that can be used to determine safe separation. The first programmable device is a microcontroller. The second programmable device can be a microcontroller or a programmable logic device. The first programmable device and the second programmable device perform a built-in test by checking the other device against a hardwired value. The ESAF device has a dynamic switch that is turned on by one of the programmable devices and controlled by the other programmable device.

36 Claims, 9 Drawing Sheets

ELECTRONIC SAFE ARM AND FIRE DEVICE

BACKGROUND

The invention relates to tactical or guided missiles, and more particularly, to electronic safe arm and fire devices.

FIG. 1 illustrates a typical guided missile. Guided missile 10 can have several different sections. For example, guided missile 10 can include a seeker section 11, a guidance section 12, a midbody section 13, a propulsion section 14, and a control section 15. Most missiles have one or more warheads that are used to inflict damage on a target. The warhead or warheads can be positioned to optimize the damage to the target. For example, a first precursor warhead can be positioned in the guidance section 12 and a second main warhead can be conveniently positioned in the midbody (or main warhead) section 13. The missile can use sensors or switches to determine contact with an object external to missile 10. These sensors or switches can be positioned in the seeker section 11 or other forward section of the missile.

An electronic safe arm and fire (ESAF) device is a standard feature on most guided missiles today. As its name suggests, an ESAF device is used to safely arm and trigger a guided missile warhead(s). An ESAF device should ensure that the missile has been launched, has traveled a minimum safe distance, and is operating properly before the warhead or warheads are armed or fired. If the missile has multiple warheads, the ESAF device should fire the warheads at delayed intervals. The missile launcher has to be confident that the warhead or warheads will detonate at the proper time.

As with the development of any new technology, the actual implementation of ESAFs has been more difficult than expected. One reason for the difficulty is that the standards for ESAFs are usually set by the Federal Government, and very often, these standards have many requirements that must be satisfied. Another reason is that there are several different types of tactical weapons and each one uses different signals and/or signal interfaces.

One example of a tactical weapon is the Hellfire II missile. The Hellfire II missile uses asynchronous serial data and single ended interfaces (i.e., one line signals) to transmit information to the ESAF device. The Hellfire II missile has a signal that is activated when the missile is launched. This signal is usually referred to as the "umbilical separation" signal. After the Hellfire II missile has been launched, a guidance section directs (or guides) the missile. A signal from the guidance section (the "fuze data" signal) indicates whether the guidance section is operating properly. An accelerometer is useful to indirectly measure the distance between the launcher and the missile ("the separation distance").

The Hellfire II missile has two warheads that are used to inflict damage on a target. The Hellfire II missile has crush switches that indicate whether the missile has contacted an object that may or may not be the target. The crush switches generate an impact signal that is used to determine when, if ever, to detonate the warheads.

Another example of a tactical weapon is the Longbow missile. The Longbow missile is very similar to the Hellfire II missile in that the Longbow missile uses asynchronous serial data and single ended interfaces (i.e., one line signals) to transmit information to the ESAF device. The Longbow missile has an umbilical separation signal, a faze data signal, and an impact signal. An accelerometer is useful to indirectly measure the separation distance.

A third example of a tactical weapon is the BAT submunition. The BAT submunition uses asynchronous pulse width modulated serial data and differential interfaces (i.e. two line signals) to transmit information to the ESAF device. The BAT submunition has an umbilical separation signal, a fuze data signal, and an impact signal. The BAT submunition falls away from a launch platform. The BAT submunition does not accelerate (or take-off) in the same way as the Hellfire II missile or the Longbow missile. For this reason, a differential pressure signal is used to calculate the separation distance.

A fourth example of a tactical weapon is the Javelin missile. The Javelin missile uses synchronous data and differential interfaces (i.e., two line signals) to transmit information to the ESAF device. While the Javelin missile does not have an umbilical separation signal, the Javelin missile has other signals (e.g., a fin lock signal) that are useful to detect whether the missile has been launched and exited its launch tube. The Javelin missile has a fuze data signal and an impact signal. An accelerometer is useful to calculate the separation distance. The Javelin missile requires two additional functions from the ESAF. These include firing the launch motor and flight motor.

ESAFs are usually lighter and smaller than their mechanical counterparts. ESAFs have arming switches that correspond to a mechanical mechanism such as a spring or a gear. Magnavox and EDI were the first companies to develop ESAFs for implementation into tactical missiles. The ESAFs built by Magnavox and EDI are built for a particular missile type using a missile specific electronics module and a set of application specific integrated circuits (ASICs).

As indicated above, and further indicated below, different missiles launch and operate differently. The various missiles come in different sizes and use different power and signal interfaces. Consequently, conventional ESAFs designed for one missile type cannot be used for another missile type. For example, a module and an ASIC designed as an ESAF for a Hellfire II missile can not be used in a BAT submunition because the BAT missile is a different size and uses asynchronous pulse width modulated serial data and a differential interface. In addition, the BAT submunition uses a differential pressure signal, and not an accelerometer, to measure separation distance.

If the Federal Government's guidelines for a missile or a missile's ESAF change, the manufacturer has to develop a new electronics module and a new ASIC. ASIC devices are expensive and time consuming to make. There is a need for an ESAF device that is readily configurable to different or new missile types, but that is inexpensive and relatively easy to make. The device should provide built-in tests and redundancies that are flexible enough to accommodate new or different guidelines. It is not a simple task to build an ESAF device for multiple missile types. An ESAF device having inputs, outputs, and circuits for every possible missile type would be prohibitively large and expensive to make.

SUMMARY

These and other drawbacks, problems, and limitations of conventional ESAF devices are overcome by a common module having a plurality of input ports and output ports and a pair of programmable devices. The ESAF device has a first static arming switch that is controlled by the first programmable device and a second static arming switch that is controlled by the second programmable device.

According to one aspect of the invention, the ESAF device has a firing module that has an exploding foil initiator containing a unique detonator. The common module and the firing module can be configured as a standalone module in close proximity to a warhead or can be integrated into a warhead.

According to another aspect of the invention, the common module has some inputs that are used by all the missiles in a group for the-same signals; some inputs that are used by all the missiles, but for different signals; and, some inputs that are used by some of the missile, but not by all of the missiles. The common module has an input port for a separation signal, a communications port for a fuze data signal, an input port for a signal that can be used to determine safe separation, and an output port that can be used for built-in test report status or telemetry and instrumentation.

According to another aspect of the invention, the first programmable device and the second programmable device are microcontrollers. Alternatively, the first programmable device may be a microcontroller and the second programmable device may be a programmable logic device.

According to another aspect of the invention, the first programmable device and the second programmable device perform a built-in test by checking each other by performing a checksum test of the other device, and verifying the checksum against a hardwired checksum register or another external references.

According to another aspect of the invention, the ESAF device has a dynamic switch that is turned on by one of the programmable devices and controlled by the other of the programmable devices.

An advantage of the invention is that the ESAF device is readily configurable to different missile types.

Another advantage of the invention is that the built-in test and redundancies are flexible to accommodate new or different guidelines.

BRIEF DESCRIPTION OF THE DRAWINGS

The foregoing, and other objects, features, and advantages of the invention will be more readily understood upon reading the following detailed description in conjunction with the drawings in which.

DETAILED DESCRIPTION

In the following description, specific details are set forth in order to provide a thorough understanding of the invention. However, it will be apparent to those skilled in the art that the invention can be practiced in other embodiments that depart from these specific details. For example, the invention can be modified to work with other missiles such as the ATACMS and FOTT missiles. In other instances, detailed descriptions of well-known methods, and circuits are omitted so as not to obscure the description of the invention with unnecessary detail.

Figure 1:
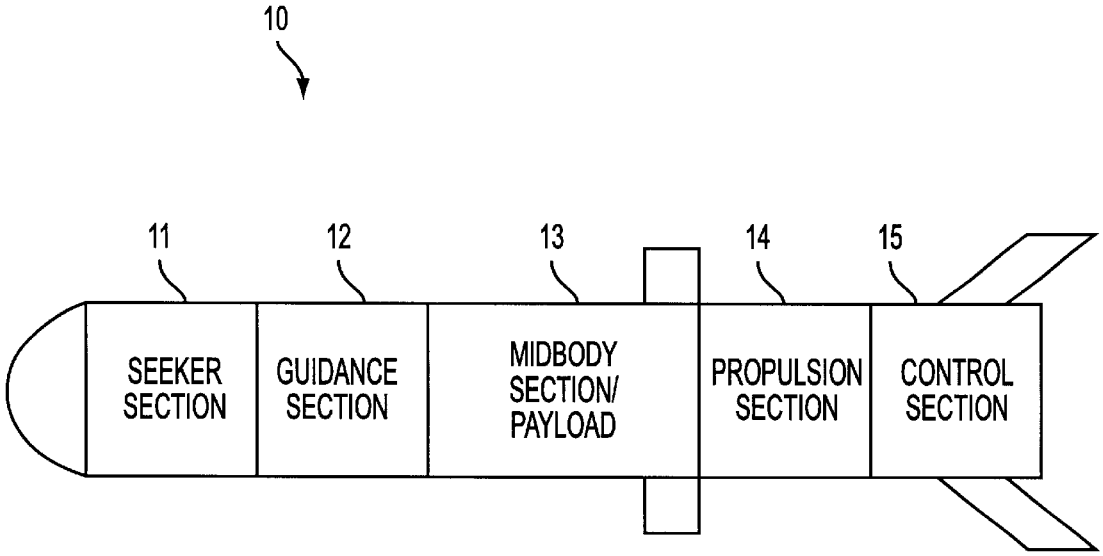
FIG. 1 illustrates a typical guided missile.
Figure 2:
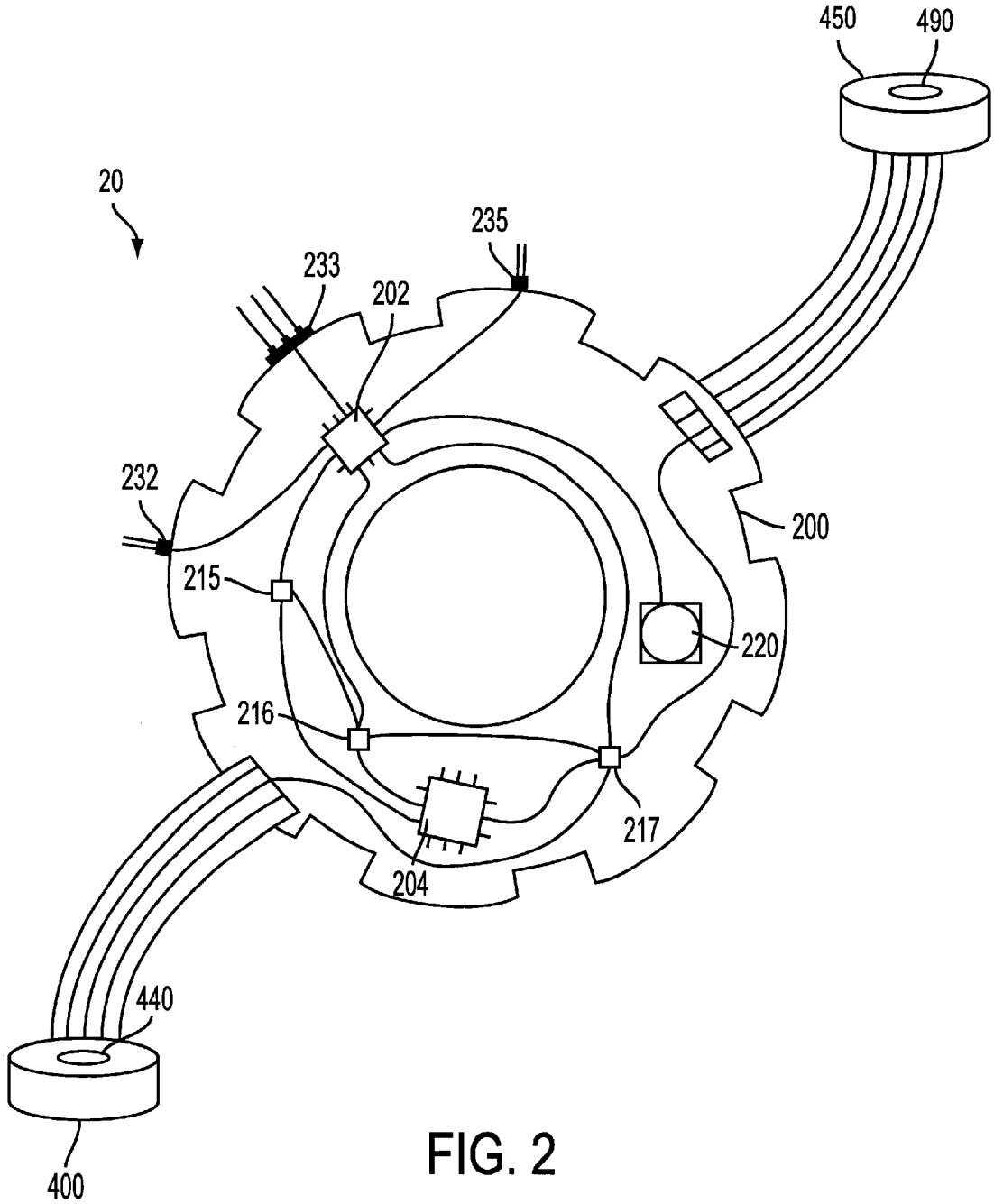
FIG. 2 illustrates an inventive electronic safe arm and fire device.

FIG. 2 illustrates an inventive electronic safe arm and fire device. ESAF device 20 has a common electronics module 200, a first firing module 400 and a second firing module 450. ESAF device 20 has a microcontroller 202 and a second programmable device 204 that are electrically connected to electronics module 200. ESAF device 20 is readily configurable to a group of different missile types because (1) the module has inputs, outputs, and circuits to accommodate each missile in the group, (2) the module 200 is small enough to fit in the smallest missile in the group, (3) devices 202 and 204 can be programmed during manufacturing, and (4) the ESAF 20 can be configured using either one or more firing modules 400.

The firing modules 400 and 450 each have an exploding foil initiator (EFI) or detonator 440 and 490 that is used to detonate two warheads, ESAF device 20 uses arming switches to either enable or disable the firing modules ability to detonate the warhead(s). The arming switches prevent the unintended arming, or initiation of the warhead(s) prior to completion of a specified sequence of events, satisfaction of environmental conditions, and achievement of safe separation distance. The number of arming switches and the inputs to the arming switches depend on the missile type.

Electronics module 200 and firing modules 400 and 450 can be positioned in separate sections of a guided missile. For example, firing module 400 can be positioned in the guidance section 12 and electronics module 200 and firing module 450 can be positioned in the midbody section 13. Each of the modules 200, 400, and 450 can be configured as standalone modules or can be integrated into a warhead or other part of the guided missile, or with each other. For example, electronics module 200 and firing module 450 can be integrated into a main warhead in the midbody section 13, while firing module 400 can be configured as a standalone module in close proximity to a precursor warhead in guidance section 12.

To actually detonate the warheads, the electronics module delivers a trigger voltage to the firing modules. Warhead initiation is provided by, for example, approximately 100 milligrams of HNS-IV initiated by an exploding foil initiator bridge. A high energy storage capacitor is charged to over 2000 volts and discharged through a triggered spark gap switch. The electronics module can deliver the trigger voltages at selectable time intervals to delay the detonation of one of the warheads.

In ESAF device 20, the arming switches are controlled by the microcontroller 202 and the second programmable device 204. Microcontroller 202 includes a microprocessor and program storage means loaded with program instructions. Microcontroller 202 has ports for discrete input and output, analog input and output, and serial and parallel interfaces. An advantage of some microcontrollers is that they are UV erasable and re-programmable. In some applications, the option of re-programing the microcontroller is advantageous. In other applications, it is better to use a non-reprogrammable microcontroller because of the real threat that the microcontroller may be inadvertently re-programmed. During manufacturing, the microcontroller is programmed or loaded with an on-board program corresponding to the intended missile type.

Programmable device 204 can be a second microprocessor. Alternatively, it may be a programmable logic device (PLD). It may be advantageous when using two microcontrollers to program each microcontroller with the same program, and to require that each microcontroller function identically in order to permit arming the warhead(s). When a PLD is used as the second programmable device 204, the microcontroller 202 and the PLD 204 may be programmed to operate independently. For example, the microcontroller 202 may be programmed to control a first arming switch and the PLD 204 may be programmed to control a second arming switch. During manufacturing, the PLD 204 should be configured to correspond to the same missile type as the microcontroller 202. Configuration of the PLD 204 is typically performed by selectively blowing any of the typically several thousand fuses that enable or disable the PLD's various logic gates.

During initial power-up, each programmable device 202 and 204 performs a built-in test to check the program memory of the other device. During the built-in test, each logic device 202 and 204 checks the other device by performing a checksum test of the other device, and verifying the checksum against a hardwired checksum register or another external reference.

Module 200 has a plurality of inputs, outputs, and circuits that are selected from a group of all possible inputs, outputs, and circuits associated with a predefined set of differing missile types. It will be evident to those skilled in the art that if module 200 comprises all possible inputs, outputs, and circuits that module 200 would be prohibitively large and expensive to make. Module 200 takes advantage of the fact that for most groups of missiles there are inputs, outputs and circuits where functions are common to the group even if the signal formats, and the like, differ from one missile to the next. Module 200 has some input ports that are used by all the missiles for the same signals; some input ports that are used by all the missiles, but for different signals; and, some input ports that are used by some of the missiles, but not by all of the missiles. It will be evident to those skilled in the art that if a module is built for one missile type and the module is used in that missile type that all the inputs are used. If one of the inputs is not used, the missile will not operate properly. In module 200, however, the module is built so that not every input need be used.

Assume, for example, that ESAF device 20 is intended for the group of missiles including Hellfire II, Longbow, BAT, and Javelin. Each of the missiles in this group use the inputs, logic voltage in and ground. Therefore, module 200 has an input 292 and an input 293 that are used by each missile for the same two signals, logic voltage in and ground. Because each missile in this group uses three arming switches in series, module 200 has three arming switches in series. Switches 215, 216, and 217 enable or disable the arming and firing of firing modules 400 and 450. The inputs to these switches are controlled by either of the two programmable devices 202 and 204. While the particular inputs to these switches 215, 216, and 217 depend on the missile, ESAF device 20 takes advantage of the fact that for the group (Hellfire II, Longbow, BAT, and Javelin) the switches 215, 216, and 217 generally require a first environmental signature (launch detection), a second environmental signature (safe separation), and an event sequence detection.

Accordingly, module 200 has an input 232 that is used for a first environmental signature. Input 232 is used by all the missiles, but for different signals depending on the missile type. In the Hellfire II, Longbow, and BAT missiles, an umbilical separation signal is used to indicate launch detection. By contrast, in a Javelin missile, a fin lock signal is used for launch detection. To ensure that each of the missiles can be accommodated, in a BAT missile or a Javelin missile, the signal used for launch detection requires a differential interface (i.e., two lines) whereas only a single-ended signal is required for the Hellfireli and Longbow missiles. To ensure that each of the missiles can be accommodated, input port 232 has openings for two lines. Both of them are used when configured for a Javelin or BAT, but in a Hellfire II or Longbow missile, the second opening is biased off. Also, in a Hellfire II, Longbow, or BAT missile, the umbilical separation signal is connected to input port 232 whereas in a Javelin missile, the fin lock signal is connected to input port 232. In either case, the first environmental signature is used by an arming switch that is controlled by the microcontroller 202. For this reason, input port 232 is wired to microcontroller 202.

Module 200 also has an input port 235 that is used for a second environmental signature. However, input port 235 is used by some of the missiles, but not by all the missiles. In the Hellfire II, Longbow, or Javelin missile, safe separation distance is dependent on a signal from an accelerometer 220 that is included on the module 200. By contrast, in a BAT missile, safe separation distance is dependent on a differential pressure signal that is supplied by an external source. In a BAT missile, the differential pressure signal is connected to input port 235. In either case, the second environmental signature is used by an arming switch that is controlled by the microcontroller 202. For this reason, input port 235 and the signal from accelerometer 220 (or bypass logic) are both wired to microcontroller 202.

Sequence detection requires information (fuze data) from the guidance section 12 of the missile. Accordingly, module 200 has a communications port 233 for receiving fuze data. In a Hellfire II or Longbow missile, the fuze data is asynchronous serial data. In a BAT missile, the fuze data is asynchronous pulse width modulated serial data. In a Javelin missile, the fuze data is synchronous data. The synchronous data in a Javelin missile requires three lines. Therefore, input 233 has openings for three lines even though the Hellfire II, Longbow, or BAT missiles require fewer than three lines. In each case, the fuze data is needed for the sequence detection, which is needed by a switch that is controlled by the microcontroller 202. For this reason, communications port 232 is wired to microcontroller 202, which ignores signals on unused lines.

Figure 3:
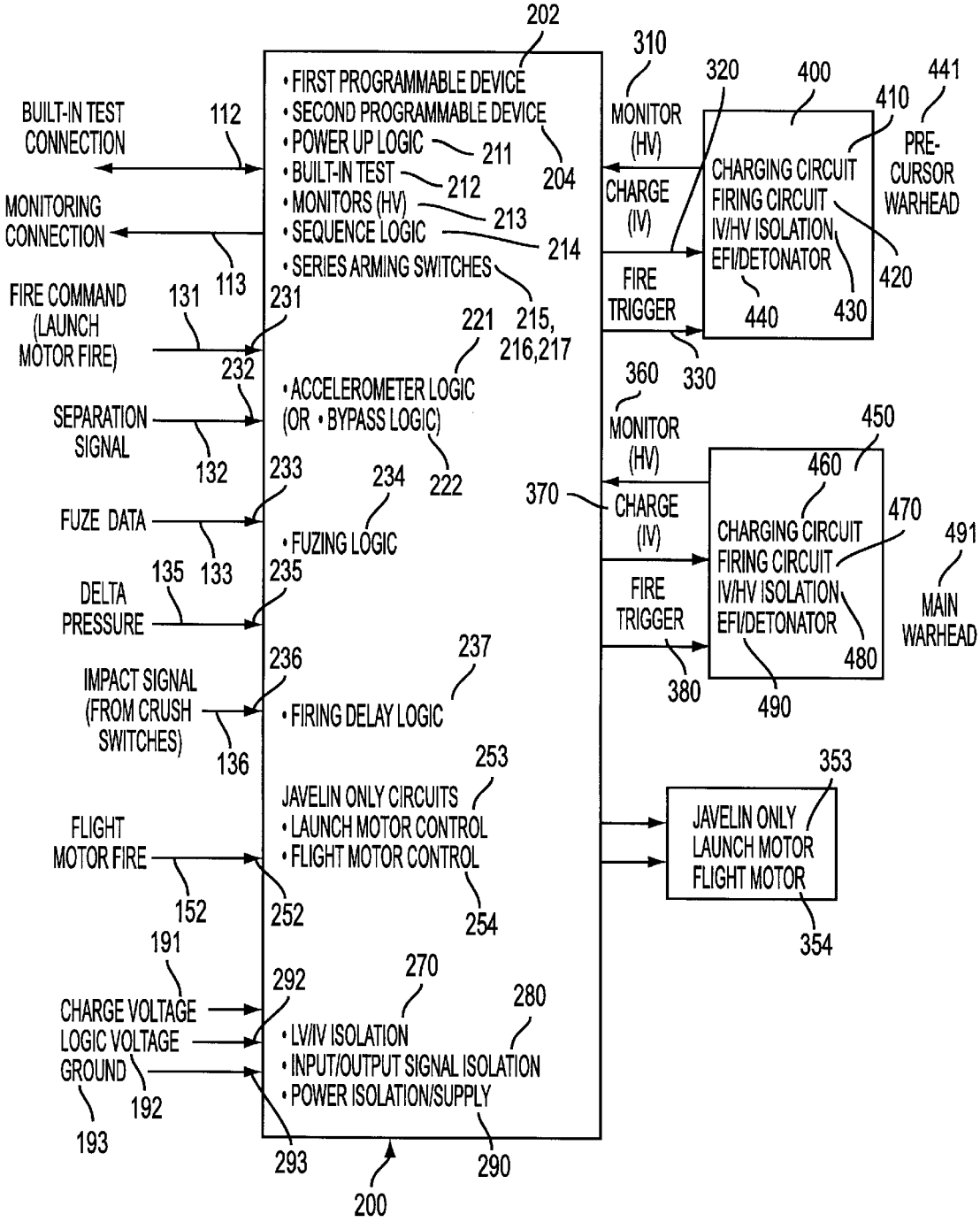
FIG. 3 is a functional block diagram of an inventive electronic safe arm and fire device.

FIG. 3 is a functional block diagram of an inventive electronic safe arm and fire device. Electronic safe arm and firing device 20 has an electronics module 200, a first programmable device 202, and a second programmable device 204. Electronics module 200 has circuits for controlling the charging and firing of firing modules 400 and 450. The electronics module 200 prevents the unintended arming, or firing of the firing modules 400 and 450, prior to completion of a specified sequence of events, satisfaction of environmental conditions, and achievement of safe separation distance. The electronics module has arming switches 215, 216, and 217 that either enable or disable a charging path. Possible switches are illustrated in FIGS. 4*a–c*, 5*a–c*, and 6*a–e* and are described more fully below.

Electronics module 200 has a power up logic circuit 211. Electronics module 200 performs a built-in test immediately after power is applied. A circuit 212 and an input/output connection 112 perform the built-in test. The built-in test checks that no premature events have occurred and that the programmable devices are functioning properly. If the built-in test fails, the arming function is inhibited. Electronics module 200 also has a circuit 213 and an input/output connection 113 for monitoring the other circuits and a circuit 214 for monitoring particular sequences of events.

Electronics module 200 has an accelerometer logic circuit 221 that is connected to an accelerometer 220 and a double integrating acceleration module. The accelerometer 220 can determine the acceleration of the missile and a double integrating acceleration module can calculate the velocity and the distance traveled by the missile. The accelerometer 220 is useful for calculating the separation distance of a Hellfire II, Longbow, or Javelin missile. The circuit 220 has bypass logic 221 for missiles such as the BAT or ATACMS which do not use an accelerometer.

Electronics module 200 has an input port 231 for receiving a launch motor fire command signal 131, a first environmental signature port 232 for receiving a separation signal 132, a communications signal port 233 for receiving a fuze data signal 133 used by fuzing logic 234, a second environmental signature port 235 for receiving a delta pressure signal 135, and an input port 236 for receiving an impact signal 136. The input port 236 can be connected to a circuit 237 for delaying the detonation of the main warhead. Circuit 253 can be used to control an output that is connected to launch motor 353.

Electronics module 200 has an input port 252 for receiving a flight motor fire signal 152. The input port 252 is connected to circuit 254. Circuit 254 can be used to control an output that is connected to a flight motor 354.

In addition, electronics module 200 has a charge voltage input signal 191, a logic voltage input signal 192, and a ground connection 193. Because the module 200 uses different voltage levels, the module 200 has a low voltage/intermediate voltage isolator 270. The module 200 also has an input/output signal isolator 280, and a power supply isolator 290.

Electronics module 200 has outputs that are connected to firing modules 400 and 450. Firing module 400 is integrated with or is in close proximity to a precursor warhead 441. Firing module 450 is integrated with or is in close proximity to a main warhead 491. Firing module 400 has an EFI/Detonator 440 that is used to detonate precursor warhead 441. Firing module 450 has an EFI/Detonator 490 that is used to detonate main warhead 491. Electronics module 200 has a circuit 237 that can be used to delay the detonation of at least one of the warheads.

Electronics module 200 uses connection 310 to monitor firing module 400, connection 320 to charge charging circuit 410, and connection 330 to trigger firing circuit 420. Because high power is used to monitor firing module 400, firing module 400 has an intermediate voltage/high voltage isolater 430.

Similarly, electronics module 200 uses connection 360 to monitor firing module 450, connection 370 to charge charging circuit 460, and connection 380 to trigger firing circuit 470. Because high power is used to monitor firing module 450, firing module 450 has an intermediate voltage/high voltage isolator 480.

It will be evident to those skilled in the art that while some of the inputs are common to all missile types, some of the inputs are missile specific. Similarly some of the circuits and outputs are common to all missile types and some of the circuits and outputs are missile specific. By identifying inputs, outputs, and circuits that are common to a missile group and/or signals that are used for the same decision made by different missiles, it is possible to create a module 200 that can accommodate each missile in the group, but yet is small enough to fit in the smallest missile in the group.

Figure 4A:
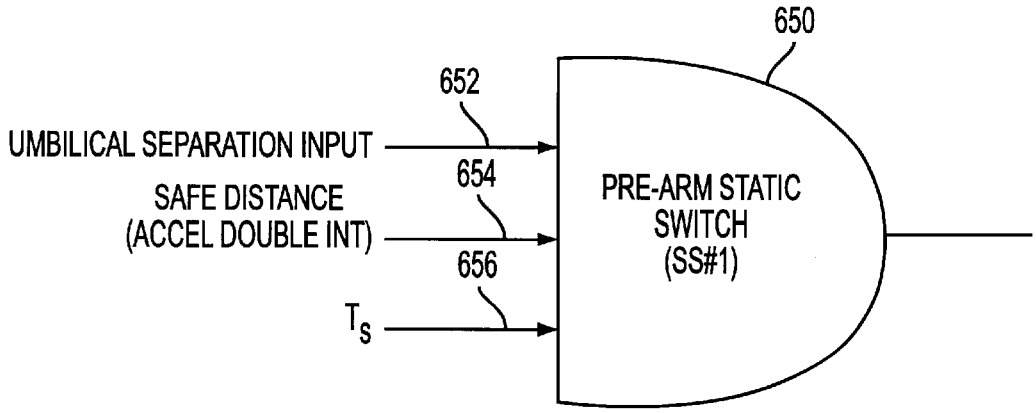
FIGS. 4*a*, 4*b*, and 4*c* illustrate three inventive switches that are useful for a Hellfire II or Longbow missile.
Figure 4B:
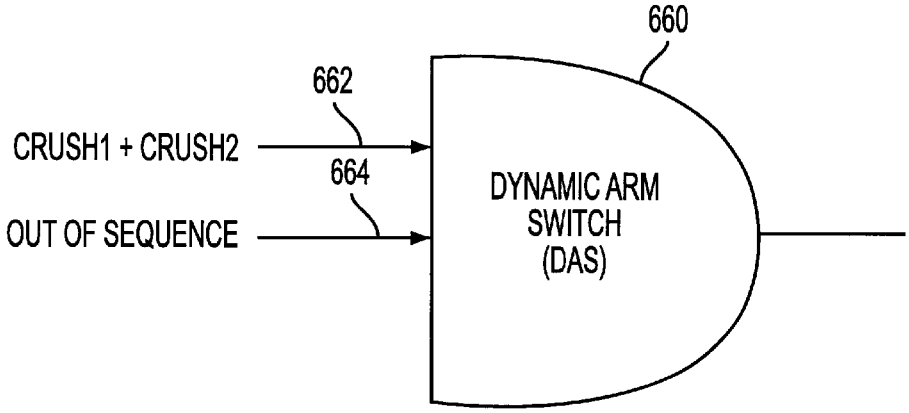
Figure 4C:
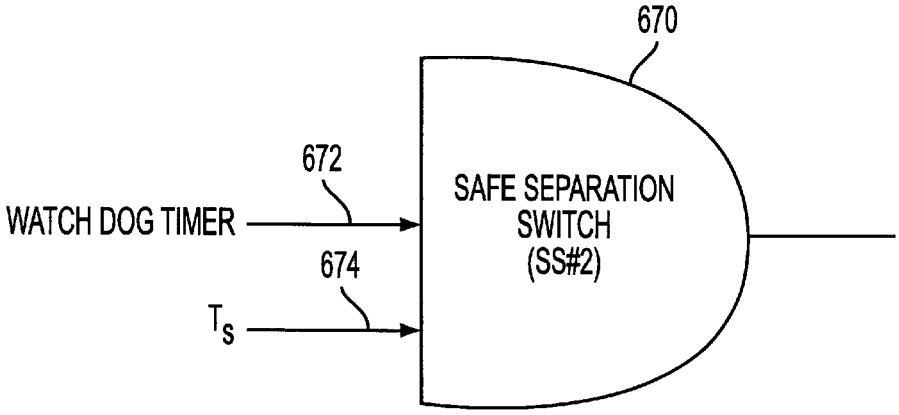

FIGS. 4*a*, 4*b* and 4*c* illustrate three switches 215, 216 and 217 that are useful for a Hellfire II or Longbow missile. These three switches can be implemented or controlled by the programmable devices 202 and 204. FIG. 4a illustrates a pre-arm static switch 650. Switch 650 has three inputs 652, 654, and 656. Switch 650 ensures that arming does not occur unless (1) the missile has been launched, (2) the missile has reached a safe distance, and (3) enough time has passed since the missile was launched. Input 652 corresponds to a first environmental signature that in the Hellfire II or Longbow missile depends on the umbilical separation signal. Input 654 corresponds to a second environmental signature that in the Hellfire II or Longbow missile depends on a signal from the accelerometer logic section of the electronics module 200. Input 656 corresponds to a signal from a clock on board the ESAF.

FIG. 4*b* illustrates a dynamic arm switch 660. Switch 660 has two inputs 662 and 664. The first input 662 depends on two contact switches and whether the missile has contacted an object. If the missile contacts an object, arming is stopped. The second input 664 is connected to a sequence detector. Input 664 depends on whether a particular order of events occurred-before and a particular order of events occurred after separation (launching). Input 664 is dependent on a fuze data signal from the guidance section of the missile. The sequence detector checks for (1) a good built-in test, (2) separation, (3) valid fuze data, and (4) a safe separation distance. The built-in test should always occur before launching or before contact. If the missile reaches a safe separation distance before the built-in test is performed, the missile should not be armed.

FIG. 4*c* illustrates a safe separation static switch 670. Switch 670 has two inputs 672 and 674. Input 672 depends on a "watch dog" timer, a backup timer that is strobed when the microcontroller device is working properly. Input 674 depends on a different clock than is used by switch 650. Switch 670 ensures that arming does not occur unless enough time has passed since the missile was launched.

According to one aspect of the invention, the microcontroller 202 controls switch 650 and the second programmable device 204 (preferably a PLD) controls switch 670. The microcontroller 202 is well suited to calculate safe separation distance. According to another aspect of the invention, the microcontroller 202 turns on switch 660 and the PLD 204 controls or pulses switch 660.

Figure 5A:
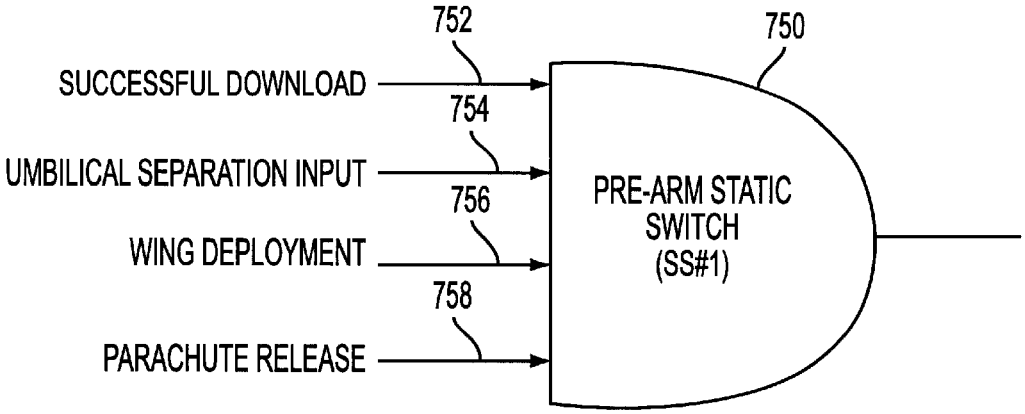
FIGS. 5*a*, 5*b*, and 5*c* illustrate three inventive switches that are useful for a BAT missile.
Figure 5B:
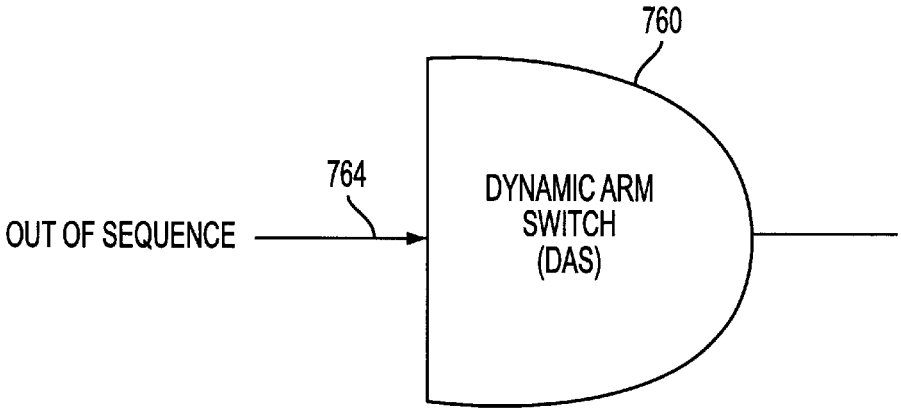
Figure 5C:
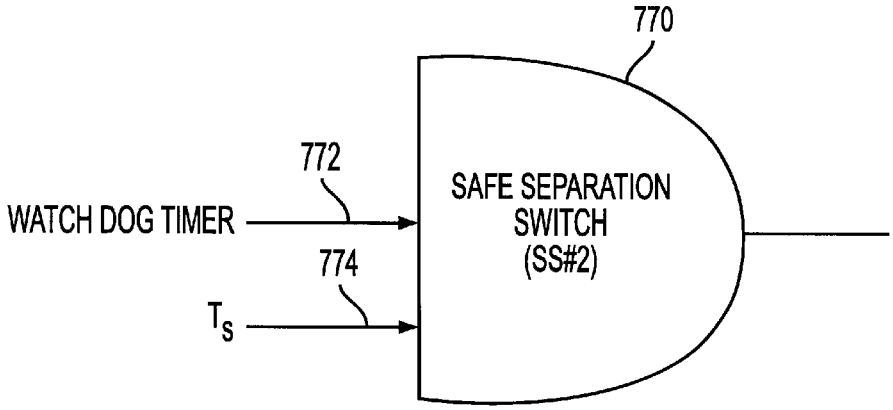

FIGS. 5*a*, 5*b*, and 5*c* illustrate three switches 215, 216, and 217 that are useful for a BAT submunition. FIG. 5*a* illustrates a pre-arm static switch 750. Switch 750 has four inputs 752, 754, 756, and 758. Switch 750 ensures that arming does not occur unless (1) there has been a successful download of information, (2) the submunition has been launched, (3) there has been wing deployment, and (4) there has been parachute release. Input 752 is for a signal indicating whether there was a successful download. Input 754 corresponds to a first environmental signature that in the BAT submunition depends on an umbilical separation signal. Inputs 756 and 758 depend on fuze data. Input 756 indicates whether there has been wing deployment. Input 758 indicates whether there has been a parachute release.

FIG. 5*b* illustrates a dynamic arm switch 760. Switch 760 has one input 764. Input 764 is connected to a sequence detector. Input 764 depends on whether a particular order of events occurred before and a particular order of events occurred after separation (launching). Input 764 is dependent on a fuze data signal and a signal that is unique to the BAT submunition, namely, a differential pressure signal. The sequence detector checks for (1) power applied, (2) a good built-in test, (3) umbilical separation, (4) wing deployment, and (5) differential pressure. The built-in test should always occur before launching. If the missile achieves a certain differential pressure before the wing deployment, the missile should not be armed.

FIG. 5*c* illustrates a safe separation static switch 770. Switch 770 has two inputs. Input 772 depends on a "watch dog" timer, a backup timer that is strobed when the microcontroller device is working properly. Input 774 depends on an internal clock. Switch 770 ensures that arming does not occur unless enough time has passed since the missile was launched.

According to one aspect of the invention, the microcontroller 202 controls switch 750 and the second programmable device 204 (preferably a PLD) controls switch 770. According to another aspect of the invention, the microcontroller 202 turns on switch 760 and the PLD 204 controls or pulses switch 760.

Figure 6A:
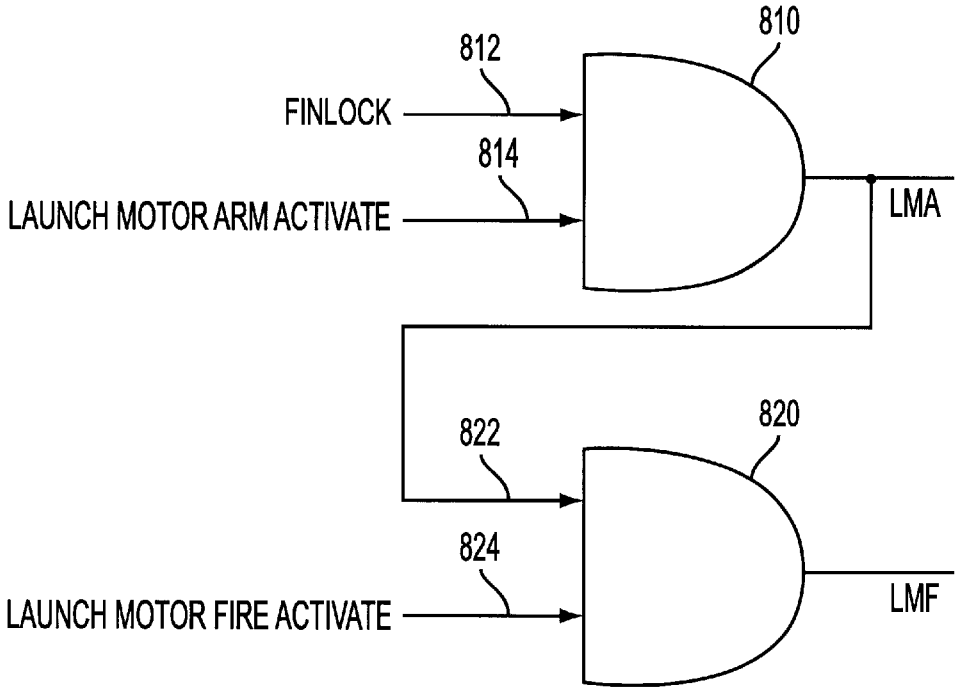
FIGS. 6*a*, 6*b*, 6*c*, 6*d*, and 6*e* illustrate seven inventive switches that are useful for a Javelin missile.
Figure 6B:
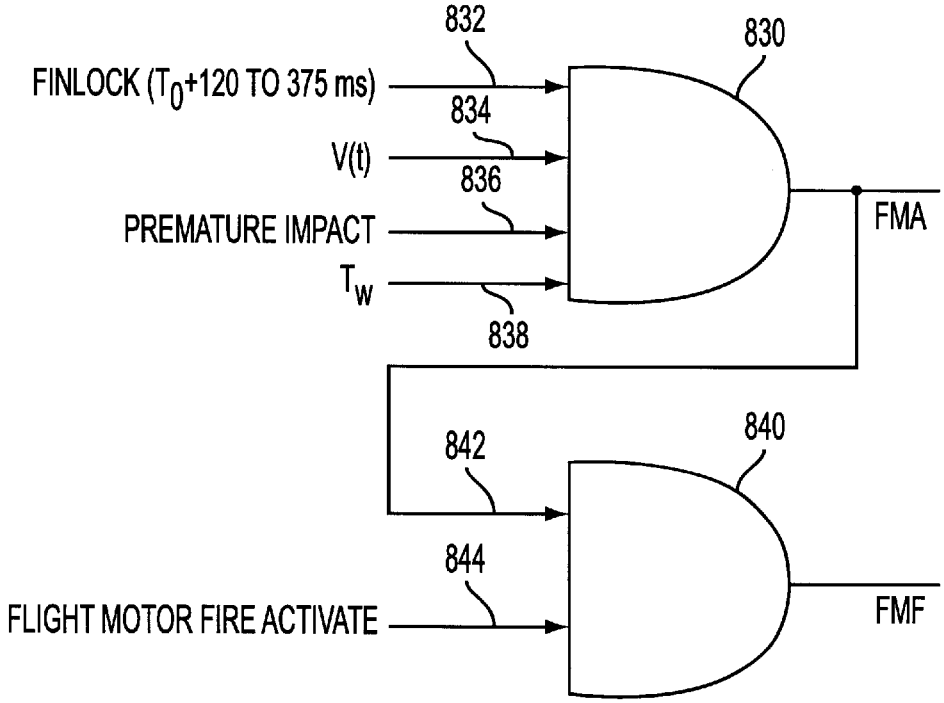

FIGS. 6*a*, 6*b*, 6*c*, 6*d*, and 6*e* illustrate seven switches that are useful for a Javelin missile. FIG. 6*a* illustrates two switches for arming and firing of a launch motor. Switch 810 is used to arm the launch motor. Switch 810 has two inputs 812 and 814. Switch 810 ensures that the launch motor is not armed unless (1) the fin is not locked and (2) there is a launch motor arm activate signal. Input 812 corresponds to the inverse of a fin lock signal. Input 814 corresponds to a launch motor arm activate signal.

Switch 820 is used to fire the launch motor. Switch 820 has two inputs 822 and 824. Switch 820 ensures that the launch motor is not fired unless (1) the launch motor has been armed and (2) there is a launch motor fire activate signal. Input 822 corresponds to the output of switch 810. Input 824 corresponds to a launch motor fire activate signal.

Switch 830 is used to arm the flight motor. Switch 830 has four inputs 832, 834, 836, and 838. Switch 830 ensures that the flight motor is not armed unless (1) the fin is locked, (2) the missile has reached a minimum velocity at a certain time after firing of the launch motor, (3) impact has not occurred, and (4) a minimum time has passed since firing of the launch motor. Input 832 corresponds to the fin lock signal. Input 834 corresponds to a velocity signal. Input 836 corresponds to the inverse of a premature impact signal. Input 838 corresponds to a clock signal.

Switch 840 is used to fire the flight motor. Switch 840 has two inputs 842 and 844. Switch 840 ensures that the flight motor is not fired unless (1) the flight motor has been armed and (2) there is a flight motor fire activate signal. Input 842 corresponds to the output of switch 830. Input 844 corresponds to a flight motor fire activate signal.

Figure 6C:
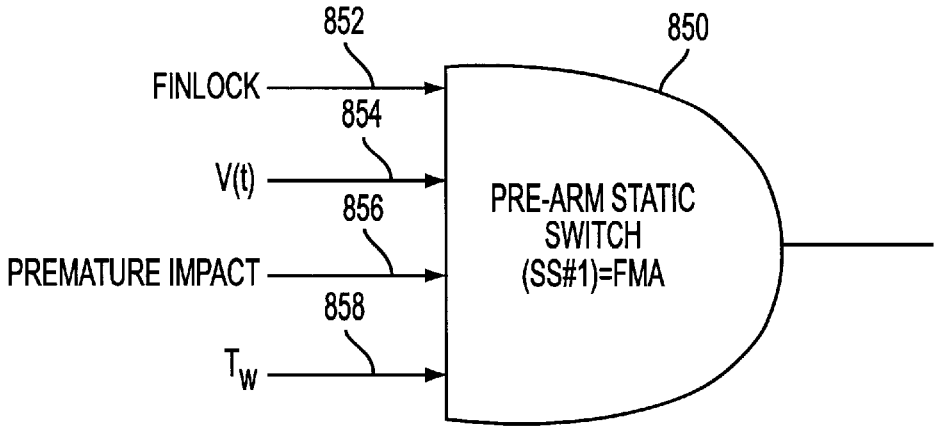

FIG. 6*c* illustrates a pre-arm static switch. Switch 850 has four inputs 852, 854, 856, and 858. Switch 850 ensures that arming does not occur unless (1) the fin is locked, (2) the missile has reached a minimum velocity at a certain time after firing of the launch motor, (3) impact has not occurred, and (4) a minimum time has passed since firing of the launch motor. Input 852 corresponds to the fin lock signal. Input 854 corresponds to a velocity signal. Input 856 corresponds to the inverse of a premature impact signal. Input 858 corresponds to a clock signal.

Figure 6D:
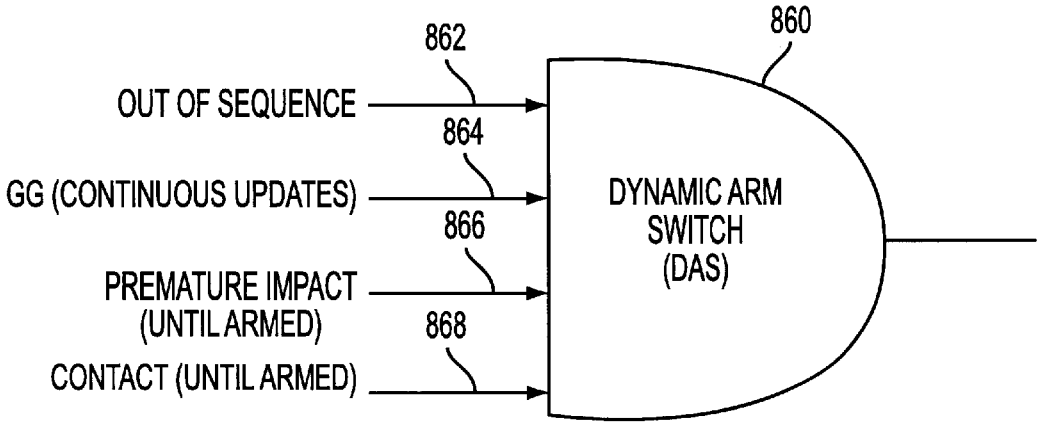

FIG. 6*d* illustrates a dynamic arm switch 860. Switch 860 has four inputs 862, 864, 866, and 868. Input 862 is connected to a sequence detector. Input 862 depends on whether a particular order of events occurred before and a particular order of events occurred after separation (launching). The sequence detector checks for (1) an output from switch 850, (2) a minimum time since launching, and (3) a safe separation distance. Input 864 depends on good fuze data. Input 866 depends on whether there was premature impact before arming. Input 868 depends on whether there was an impact signal before arming.

Figure 6E:
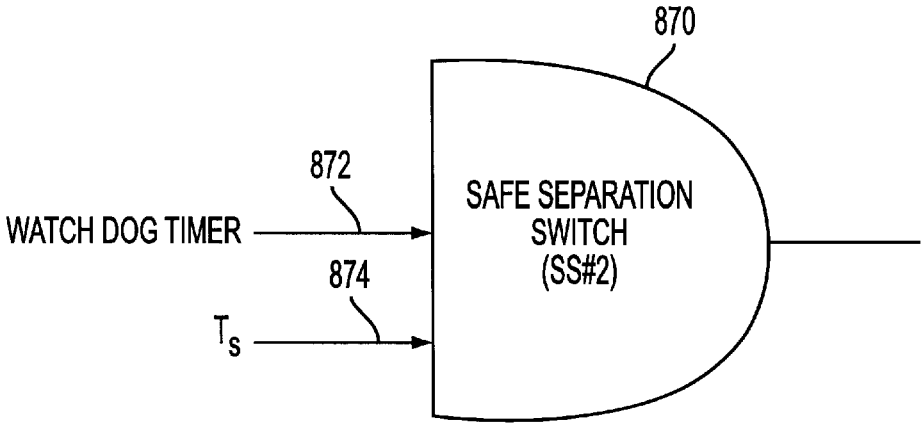

FIG. 6*e* illustrates a safe separation static switch 870. Switch 870 has two inputs. Input 872 depends on a "watch dog" timer. Input 874 depends on an internal clock. Switch 870 ensures that arming does not occur unless enough time has passed since the missile was launched.

According to one aspect of the invention, the microcontroller 202 controls switch 850 and the second programmable device 204 (preferably a PLD) controls switch 870. According to another aspect of the invention, the microcontroller 202 turns on switch 860 and the PLD 204 controls or pulses switch 860.

Figure 7:
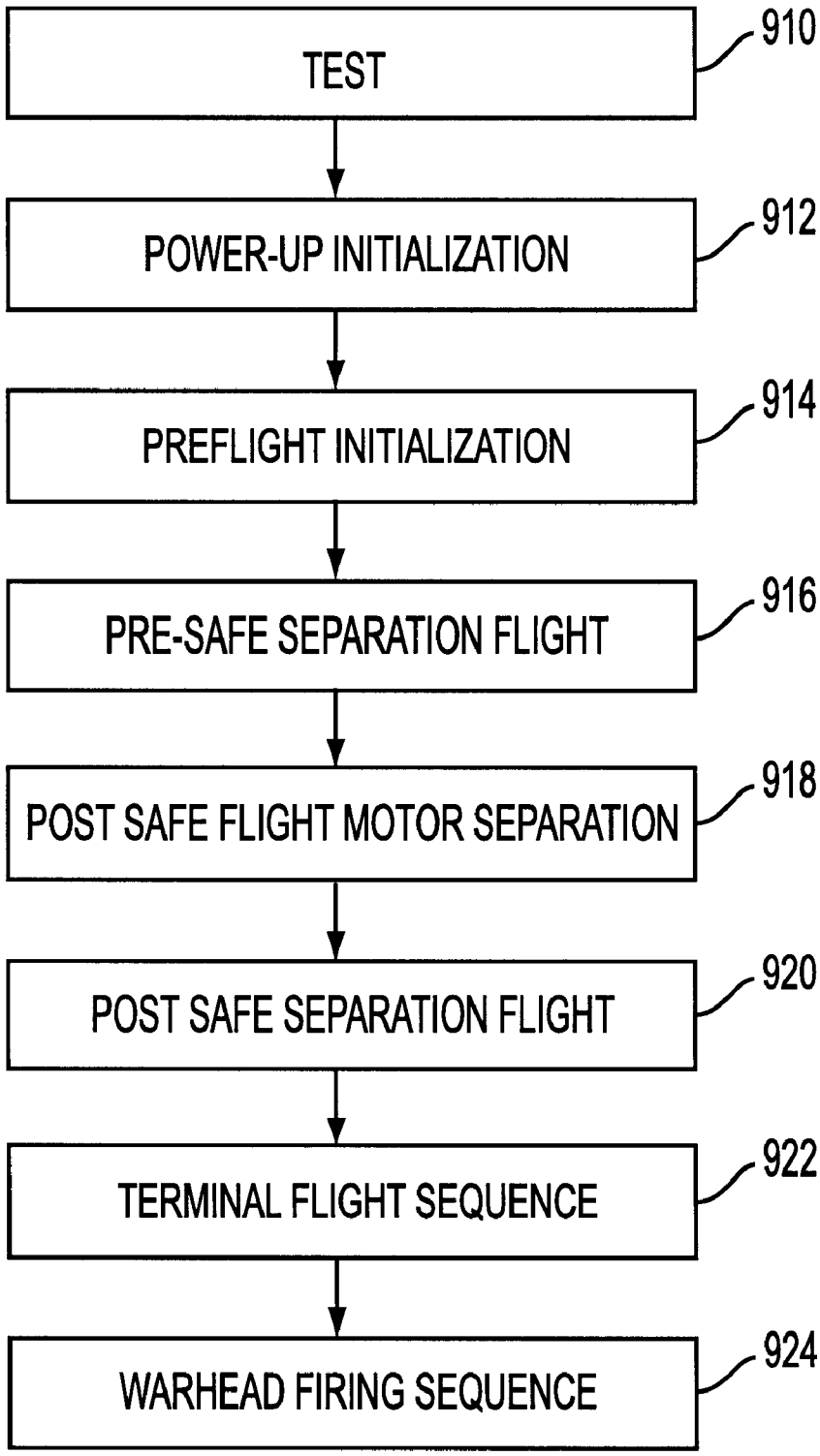
FIG. 7 is a flow chart of exemplary modes of an inventive electronic safe arm and fire device; and, FIG. 8 is a flow chart of the operation of an inventive electronic safe arm and fire device.

FIG. 7 is a flowchart of exemplary modes of an inventive electronic safe arm and fire device. These modes are controlled by two programmable devices. During step 910, ESAF device enters a special test mode. The special test mode involves both hardware and software techniques. The ESAF device checks the accelerometer 220 and separation signal 232 to verify that the device did not inadvertently enter test mode from flight mode. During test mode, voltage is routed and applied to each driver section. A processor verifies that the drivers are operating properly via analog feedback measurements and combinatorial states. The device tests the accelerometer 220 and electronically checks its outputs. This entire test is automated and controlled within a sequencer in the ESAF device. The results are reported from a microcontroller 202 via a serial output.

During step 912, the ESAF device enters power-up initialization mode. During power-up initialization mode, the ESAF device initializes itself by first performing a power supply check and a power on reset initialization. The discrete input/output ports, the analog input/output ports, and the serial and parallel interfaces are configured. Line receivers and transmitters are configured to place the appropriate inputs to the ESAF onto an internal bus. The inputs will depend on the missile type.

There are two independent clocks that provide timing to the first programmable device and the second programmable device. A watchdog timer is also enabled. The ESAF exchanges and compares its preprogrammed unique program configuration ID between major logic entities, and initializes the accelerometer 220. Each device performs a comparison to verify that each unique program configuration ID matches a hardwired value. If the IDs do not match, the system is halted and no charging or firing actions can occur. If the checksums are correct then a pass flag is generated in both of the two programmable devices 202 and 204. During the entire sequence, the absence of a pass flag in either programmable device inhibits that device from entering the next mode.

During step 914, the ESAF device enters preflight initialization mode. During preflight initialization mode, the ESAF performs a pre-launch test that includes (1) verifying that the acceleration inputs equal zero, (2) the static inputs (separation, crush/contact, fuze data, etc.) are in the correct state, (3) the driver outputs (static and dynamic pump switches, firing switches, and motor drivers) are in an off state. In the Hellfire and Longbow missiles, the ESAF performs the additional step of ensuring that the warhead power is not applied. If all conditions are satisfied, a pass flag is generated in both of the two independent logic devices. During the entire sequence, the absence of a pass flag in either programmable device inhibits the device from entering the next mode. A transmitted bit status is sent from the ESAF to indicate that all checks passed. In a Javelin missile, when a launch motor arm and fire command is detected, a fire pulse is sent to the launch motor driver.

During step 916, the ESAF device enters pre-safe separation flight mode. In the Hellfire and BAT submunition, the ESAF device enters pre-safe separation mode when a separation signal is detected. In a Javelin missile, the ESAF device enters pre-safe separation mode when the launch motor fire pulse is sent to the launch motor driver. One of the logic devices calculates the separation distance by using the accelerometer 220 to measure the acceleration and double integrating the acceleration value to get a distance value. In addition, one of the programmable devices uses a timer to generate a pre-defined time-out period. For a Javelin missile, post safe flight motor separation has to be completed before this calculation can be completed.

Meanwhile the other programmable device starts an independent pre-defined time-out period timer. At the same time the other programmable device receives fuze data from an external source (the guidance computer in the guidance section). The programmable device checks the fuze data to see if the data is error free. Upon receipt of good data, the logic device obtains and saves the timing information for warhead detonation and the fuze good flag is set. If the data contains safety environment data (delta pressure), this information is also used to enable the good fuze flag. When safe distance is achieved a pass flag is generated in both of the two programmable devices. During the entire sequence, the absence of a pass flag in either device inhibits that device from entering the next mode.

During step 918, the ESAF device enters post safe flight motor separation. In post safe flight motor separation mode the flight motor can be fired assuming the safety constraints are met for arming.

During step 920, the ESAF device enters post safe separation flight. In post safe separation flight mode, the two programmable devices 202 and 204 are responsible for controlling the static switches. The two programmable devices check for safe separation, valid fuze data, valid environment data, proper power, and that no contact switch closure has been detected. When pass conditions are satisfied, a pass flag is generated in both of the two devices. During the entire sequence, the absence of a pass flag in either device inhibits either device from entering the next mode. Once the pass flag is generated, the warhead firing voltage is pumped up. The pumping up is initiated by the dynamic switch being pulsed at a switching rate to provide an intermediate voltage that starts charging a capacitor in a firing module. The switching rate should be at a frequency rate that precludes inadvertent coupling of signals available in the ESAF or system from energizing the pump. It is important to control the high voltage on the capacitor within an acceptable bandwidth. Too low a voltage will not guarantee that the EFI will detonate the warhead when fired and too high a voltage on the capacitor will cause failure or breakdown of the peak voltage. The pump rate should be controlled so that a proper voltage is maintained across the capacitor.

During step 922, the ESAF device enters terminal flight sequence. In terminal flight sequence mode, the main function of the ESAF is to detect impact or time out and to control the pump rate to ensure a proper voltage across a capacitor. During this time one of the programmable devices 202, 204 should continually check the contact switches for activation. In addition to generating high voltage, the firing module should convert some of the energy to supply voltage for the warhead trigger pulse transformer. When impact is detected a pass flag should be generated in both programmable devices. If no impact is detected with an allotted time then the system should safely remove the pump voltage and discharge the firing module arming energy through resistive networks instead of the EFI.

During step 924, the ESAF device enters warhead firing sequence. The device enters warhead firing sequence mode when impact is detected within an allotted time and a valid terminal flight sequence mode pass flag has been generated. In the warhead firing sequence mode, the pumping of the firing module capacitors is stopped. All inputs to the ESAF are disabled. The precursor warhead is fired, and the timer for the delay to the main warhead firing module is started. The ESAF is capable of functioning on its own power using stored energy in its power circuits. After the time allotted for the delay is finished, the main warhead is fired.

Figure 8:
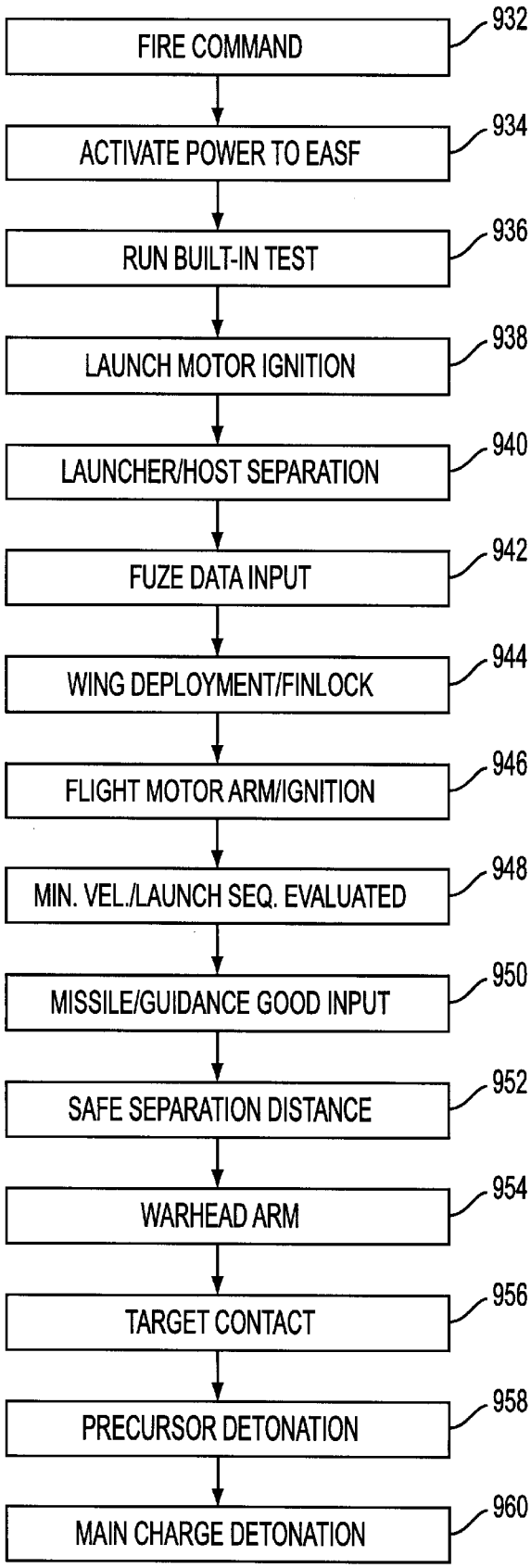

FIG. 8 is a flowchart of the operation of a guided missile in accordance with the present invention. Step 932 is initiated by, for example, a trigger pull. The fire command starts the missile launch process. The next step 934 involves activating power to, for example, the logic circuits and a firing circuit.

Step 936 involves running a built-in test. The built-in test involves checking the missile and pre-launch conditions. Step 938 involves igniting the launch motor. Step 938 is the point of umbilical separation and the point that acceleration begins. Acceleration should not start until the built-in test is finished.

Step 940 involves the actual separation of the missile from the launcher or the missile host. The duration of step 940 is the longest for tube launched missiles.

Step 942 involves receiving fuze data. There are several formats of fuze data and the fuze data is unique to each missile type.

Step 944 is specific to Javelin missiles. Step 944 involves deploying the wings and fin lock. A signal corresponding to the fin lock can be used by the arming switches in place of an umbilical separation signal. Step 946 is also specific to Javelin missiles. Step 946 involves arming and igniting a flight motor.

Step 948 involves determining the velocity of the missile and evaluating the launch sequence. Arming should not begin until the missile has reached a minimum velocity, and unless there was a proper launch sequence. Step 950 involves evaluating the fuze data to determine whether the guidance section is operating properly.

Step 952 involves determining the distance the missile has traveled. If the missile has reached a safe separation distance and all the safety conditions are satisfied, the missile can begin arming.

Step 954 involves the point at which the warhead is armed. During step 954, the missile should monitor the firing charge and make sure that a proper voltage is maintained. Step 956 involves target contact. Step 956 is initiated by the contact switches. Step 958 involves the detonation of a precursor warhead. Step 960 involves the detonation of a main warhead.

The preceding description of the preferred embodiments are provided to enable any person skilled in the art to make and use the present invention. Various modifications to these embodiments will be readily apparent to those skilled in the art, and the principles described herein may be applied without departing from the scope and spirit of the present invention. For example, the disclosed methods and structures can be used with other missile types such as ATACMS and FOTT. Thus, the present invention is not limited to the disclosed embodiments, but is to be accorded the widest scope consistent with the claims below.

What is claimed is:

1. A device for controlling the arming and firing of a missile that is configurable to different missile types, the device comprising:

a first arming switch;

a second arming switch;

a first programmable device for controlling the first arming switch; and a second programmable device for separately controlling the second arming switch, wherein at least one of the first and second programmable devices is a microcontroller.

2. A device as described in claim 1, the device further comprising a firing module, the firing module comprising an exploding foil initiator.

3. A device as described in claim 2, wherein the firing module is configured as a standalone module in close proximity to a warhead.

4. A device as described in claim 2, comprising a common module having a plurality of input ports and output ports, wherein the common module and the firing module are integrated into a warhead.

5. A device as described in claim 4, wherein the first programmable device and the second programmable device are programmed for a first missile type.

6. A device as described in claim 5, wherein the common module has an input port for a first line and a second line, and the first missile type only requires the first line.

7. A device as described in claim 6, wherein the second line is disabled.

8. A device as described in claim 7, wherein the input port is for a separation signal.

9. A device as described in claim 8, wherein the separation signal is selected from the group consisting of an umbilical separation signal and a fin lock signal.

10. A device as described in claim 5, wherein the common module has a communications port that includes three lines, and the first missile type does not require three lines.

11. A device as described in claim 10, wherein the communications port is for a fuze data signal.

12. A device as described in claim 11, wherein the fuze data signal can be a synchronous or an asynchronous signal.

13. A device as described in claim 5, wherein the common module has an input for a signal, and the first missile type does not require the signal.

14. A device as described in claim 13, wherein the input is used by a second missile type for a differential pressure signal.

15. A device as described in claim 14, wherein the first missile type uses an accelerometer to determine safe separation.

16. A device as described in claim 4, wherein the common module has an input for a signal that is used to determine safe separation.

17. A device as described in claim 16, further comprising bypass logic for a signal from an accelerometer.

18. A device as described in claim 1, comprising:

a common module, having a plurality of input ports, wherein the common module has an input port for a separation signal and the input port is connected to the first programmable device.

19. A device as described in claim 1, wherein the first programmable device is connected to a signal that is used to calculate safe separation.

20. A device as described in claim 19, wherein the signal that is used to calculate safe separation is alternatively supplied to an input port or an accelerometer, and wherein further the first programmable device is configured to receive the signal from one of the input port or the accelerometer.

21. A device as described in claim 1, wherein the first programmable device is a microcontroller and the second programmable device is a microcontroller.

22. A device as described in claim 1, wherein the first programmable device is a microcontroller and the second programmable device is a programmable logic device.

23. A device as described in claim 1, wherein the first programmable device checks the second programmable device against a hardwired value.

24. A device as described in claim 23, wherein the second programmable device checks the first programmable device against a hardwired value.

25. A device as described in claim 1, further comprising a dynamic switch that is connected in series with the first static arming switch and the second static arming switch.

26. A device as described in claim 25, wherein the dynamic switch is turned on by the first programmable device, and the dynamic switch is pulsed by the second programmable device.

27. A device as described in claim 26, wherein the first programmable device uses a sequence detector to control the dynamic switch.

28. A device as described in claim 27, wherein the first programmable device is connected to a communication port.

29. A device as described in claim 28, wherein the first programmable device is a microcontroller.

30. A device for controlling the arming and firing of a missile that is configurable to different missile types, the device comprising:

a first arming switch;

a second arming switch;

a first programmable device for controlling the first arming switch; and a second programmable device for separately controlling the second arming switch, wherein the first programmable device performs at least one test on the second programmable device.

31. A device as claimed in claim 30, wherein the second arming switch is activated by the second programmable device in response to the outcome of the at least one test.

32. A device as claimed in claim 30, wherein at least one of the first and second arming switches is a dynamic switch.

33. A device as claimed in claim 30, wherein at least one of the first and second arming switches is a static switch.

34. A device as claimed in claim 30, wherein the first programmable device is a microcontroller.

35. A device as claimed in claim 30, wherein the first programmable device is a programmable logic device.

36. A device as claimed in claim 34, wherein the second programmable device is a programmable logic device.

* * * * *